US007922187B2

(12) United States Patent
Fremgen

(10) Patent No.: US 7,922,187 B2
(45) Date of Patent: Apr. 12, 2011

(54) ATROPHY-REDUCING MOVABLE FOOT SUPPORT APPARATUS

(76) Inventor: Bonnie Fremgen, Sherman, CT (US)

( * ) Notice: Subject to any disclaimer, the term of this patent is extended or adjusted under 35 U.S.C. 154(b) by 203 days.

(21) Appl. No.: 12/251,516

(22) Filed: Oct. 15, 2008

(65) Prior Publication Data

US 2010/0090436 A1 Apr. 15, 2010

(51) Int. Cl.
*A61G 5/10* (2006.01)

(52) U.S. Cl. ..... 280/304.1; 280/288.4; 280/250.1; 297/423.1

(58) Field of Classification Search ..... 280/304.1, 280/288.4, 250.1, 242.1, 291; 180/205; 297/423.1
See application file for complete search history.

(56) References Cited

U.S. PATENT DOCUMENTS

| | | | | |
|---|---|---|---|---|
| 3,865,220 | A | 2/1975 | Thompson, Jr. | |
| 3,994,509 | A * | 11/1976 | Schaeffer | 280/250.1 |
| 4,324,414 | A | 4/1982 | Wilkes | |
| 4,523,769 | A * | 6/1985 | Glaser et al. | 280/252 |
| 4,572,501 | A | 2/1986 | Durham et al. | |
| 5,273,304 | A | 12/1993 | Berkheimer | |
| 5,324,060 | A * | 6/1994 | Van Vooren et al. | 280/304.1 |
| 5,362,081 | A | 11/1994 | Beidler et al. | |
| 6,142,914 | A | 11/2000 | Crawford et al. | |
| 6,196,565 | B1 * | 3/2001 | Chubbuck | 280/255 |
| 6,220,615 | B1 * | 4/2001 | Chubbuck | 280/304.1 |
| 6,341,671 | B1 | 1/2002 | Ebersole | |
| 6,648,354 | B2 * | 11/2003 | James | 280/255 |
| 7,036,838 | B2 * | 5/2006 | Leffler | 280/304.1 |
| 7,118,515 | B2 | 10/2006 | Kassel et al. | |
| 7,293,623 | B2 * | 11/2007 | Berkelmans | 180/205 |
| 2002/0101054 | A1 * | 8/2002 | James | 280/250.1 |
| 2007/0114750 | A1 | 5/2007 | Dix et al. | |

* cited by examiner

*Primary Examiner* — Paul N Dickson
*Assistant Examiner* — Tashiana Adams
(74) *Attorney, Agent, or Firm* — McCormick, Paulding & Huber LLP

(57) ABSTRACT

Gentle and substantially linear vertical motion of a wheelchair foot support is expected to provide superior results for maintenance of a wheelchair user's leg muscle mass' thus reducing atrophy of the wheelchair user's legs. Additionally, gentle continuous motion of the foot support is expected to aid in maintaining elasticity of the wheelchair user's leg joint ligaments' thus reducing contractures. Accordingly, an atrophy-reducing wheelchair includes a movable foot support mounted to a linkage that is movably connected to the wheelchair frame. As the wheelchair moves in normal operation, rotation of a wheelchair wheel drives the linkage to provide substantially linear vertical reciprocation of the foot support.

18 Claims, 7 Drawing Sheets

ATROPHY-REDUCING MOVABLE FOOT SUPPORT APPARATUS

FIELD OF THE INVENTION

The present invention relates generally to wheelchairs and, more particularly, to an atrophy-reducing movable foot support apparatus for use on wheelchairs.

BACKGROUND OF THE INVENTION

Typical wheelchair designs employ a sturdy frame supporting a seat assembly. The seat assembly includes arm rests and push bars to allow the wheelchair to be pushed by an aide. Attached to the rear of the frame is a pair of drive wheels. The drive wheels are typically large diameter wheels attached to a central hub with spokes. Push rims are mounted to the drive wheels to allow the wheelchair occupant to propel the chair using their arms and upper body. A smaller pair of pivoting castor wheels is attached to the front of the frame to provide steerability. Extending down from the lower front of the wheelchair frame is a footrest system to support the lower legs. The footrest system typically includes a pair of bars, one mounted to each side of the frame. Attached to each bar is a footrest, which typically may be pivoted up and out of the way to provide clearance if the occupant so desires. Adjustment mechanisms allow each bar to slide in adjustment relative to the frame to accommodate the differing heights and leg lengths of the wheelchair occupant.

One drawback to existing wheelchairs is that the footrest system, once adjusted for the particular size of the occupant, remains locked in a fixed position. As a result, the occupant's legs are stationary while seated in the wheelchair. Over extended periods of time, a wheelchair occupant who is not able to move their legs on their own may develop atrophy in the leg muscles and contracture of the leg joint ligaments.

Muscular atrophy is a decrease in muscle mass resulting from, among other things, lack of use. Muscular atrophy begins within a few days after confinement to a wheelchair, and is a major factor preventing full recovery from leg injuries. Over longer periods of time, muscles in the leg may deteriorate completely.

Contracture of ligaments is a loss of elasticity resulting from lack of use. Like muscular atrophy, contracture may begin to set in soon after confinement to a wheelchair, and is a second major factor preventing full recovery from leg injuries. Extremely painful stretching exercises and other physical therapies are required to restore contracted ligaments to anything approaching pre-injury conditions.

Efforts have been made to prevent muscle atrophy and contractures by providing continuous motion of a wheelchair occupant's legs. For example, one prior art solution is provided by U.S. Pat. No. 5,324,060 issued to Van Vooren et al. The '060 patent discloses a wheelchair cycle apparatus that includes a frame to which is attached a connecting device for connecting the frame to a wheelchair. A drive wheel and driven wheel are attached to the frame. A pair of pedals are attached to either the drive wheel or the driven wheel depending upon whether the user can move his/her own legs. A chain connects the drive wheel to the driven wheel. The wheelchair cycle apparatus may be connected to the frame of a wheelchair to produce a wheelchair assembly that enables a disabled individual to exercise his/her own legs while seated in the wheelchair.

However, the wheelchair cycle apparatus shown in the '060 patent requires the disabled individual to assume a non-standard position in the wheelchair. Additionally, the forwardprotruding cycle frame makes the wheelchair cycle apparatus occupy a larger envelope of space than does a conventional wheelchair. Since building accesses and other public services have been specifically designed to accommodate conventional wheelchairs, these public services may not accommodate the wheelchair cycle apparatus of the '060 patent.

SUMMARY OF THE INVENTION

It is an object of the present invention to provide an apparatus for use with a wheelchair that produces gentle and substantially linear vertical motion of a movable foot support and is expected to provide superior results for maintenance of a wheelchair user's leg muscle mass, thus reducing atrophy of the wheelchair user's legs.

According to one aspect of the present invention, a wheelchair is provided with a movable foot support assembly that reduces leg muscle atrophy and ligament contracture.

According to another aspect of the present invention, a wheelchair is provided with a movable foot support assembly that reduces leg muscle atrophy without substantially exceeding the dimensions of a conventional wheelchair.

According to another aspect of the present invention, a collapsible wheelchair is provided with a movable foot support assembly that reduces leg muscle atrophy without hindering collapsible motion of the wheelchair for storage.

In one embodiment of the present invention, an atrophy-reducing wheelchair comprises a movable foot support assembly that is driven by rotation of a rear wheel of the wheelchair.

In another embodiment of the present invention, an atrophy-reducing wheelchair includes first and second side frames, each side frame including rigidly connected structural members lying substantially in a corresponding plane, a front wheel bracket pivotally connected to one of the structural members, and a rear wheel mount formed in one or another of the structural members and defining a rear wheel axis, and at least one of the first and second side frames being modified to include a pivot and a journal, each journal defining a journal axis substantially perpendicular to the plane of the corresponding side frame, each pivot defining a pivot axis substantially perpendicular to the plane of the corresponding side frame and also defining horizontal and vertical axes substantially perpendicular to the pivot axis, a front wheel being rotatably mounted to each front wheel bracket, and a rear wheel being rotatably mounted to each rear wheel mount, the rear wheel axis of the second side frame being substantially in registration with the rear wheel axis of the first side frame, and the second side frame being offset from the first side frame along the rear wheel axes. First and second pivotally connected crossbars, having upper and lower ends and together defining a plane substantially perpendicular to the first and second planes, collapsibly connect the first and second side frames, the lower end of the first crossbar being pivotally connected to the second side frame and the upper end of the first crossbar carrying a first longitudinal bar lying substantially in the first plane and slidably connected to the first side frame, the lower end of the second crossbar being pivotally connected to the first side frame and an upper end of the second crossbar carrying a second longitudinal bar lying substantially in the second plane and slidably connected to the second side frame, the crossbars and longitudinal bars cooperating to permit motion of the first and second side frames between an open position in which the second side frame is offset from the first side frame by a seat width and a closed position in which the second side frame is offset from the first side frame by a collapsed width. A sling seat is supported between the first and second longitudinal bars. At least one linkage is movably connected to the modified side frame at the pivot and the journal, the linkage carrying a movable foot support; and a belt flexibly connects the linkage to the rear wheel of the modified side frame, such that rotation of the rear wheel drives the linkage to move the movable foot support.

In another embodiment of the present invention, an atrophy-reducing foot support assembly for use on a wheelchair having a modified side frame includes a foot support; a crank arm having a proximal end, a distal end, and a middle segment connecting the proximal and distal ends, the distal end carrying the foot support and the proximal end being pivotally mounted to a pivot of the modified side frame; an axle assembly rotatably mounted in a journal of the modified side frame, having an outer circumferential surface and having a rod pin extending substantially parallel to the journal axis at a radial distance from the journal axis; a push-rod having a driven end and having a driving end, the driven end being pivotally connected to the rod pin; a crank pin pivotally connecting the driving end of the push-rod to the middle segment of the crank arm; a drive wheel fixedly and substantially co-axially mounted to the rear wheel of the first side frame, the drive wheel having an outer circumferential surface; and a belt engaging the outer circumferential surface of the axle assembly and the outer circumferential surface of the drive wheel, thereby flexibly coupling the axle assembly to the drive wheel. When the wheelchair moves forward or backward, motion of the rear wheel of the modified side frame causes oscillating motion of the foot support.

In another embodiment of the present invention, an atrophy-reducing foot support assembly for use on a wheelchair having a modified side frame includes a foot support; an axle assembly rotatably mounted in a journal of the modified side frame, having an outer circumferential surface and having a rod pin extending substantially parallel to the journal axis at a radial distance from the journal axis; a push-rod having a driven end, a driving end, and a middle segment connecting the driving and driven ends, the driving end carrying the foot support and the driven end being pivotally connected to the rod pin; a crank arm having a proximal end and a distal end, the distal end being pivotally mounted to the middle segment of the push-rod by a crank pin, and the proximal end being pivotally mounted to a pivot of the modified side frame; a drive wheel fixedly and substantially co-axially mounted to the rear wheel of the modified side frame, the drive wheel having an outer circumferential surface; and a belt engaging the outer circumferential surface of the axle assembly and the outer circumferential surface of the drive wheel, thereby flexibly coupling the axle assembly to the drive wheel. When the wheelchair moves forward or backward, motion of the rear wheel of the modified side frame causes oscillating motion of the foot support.

DETAILED DESCRIPTION OF PREFERRED EMBODIMENTS

Figure 1:
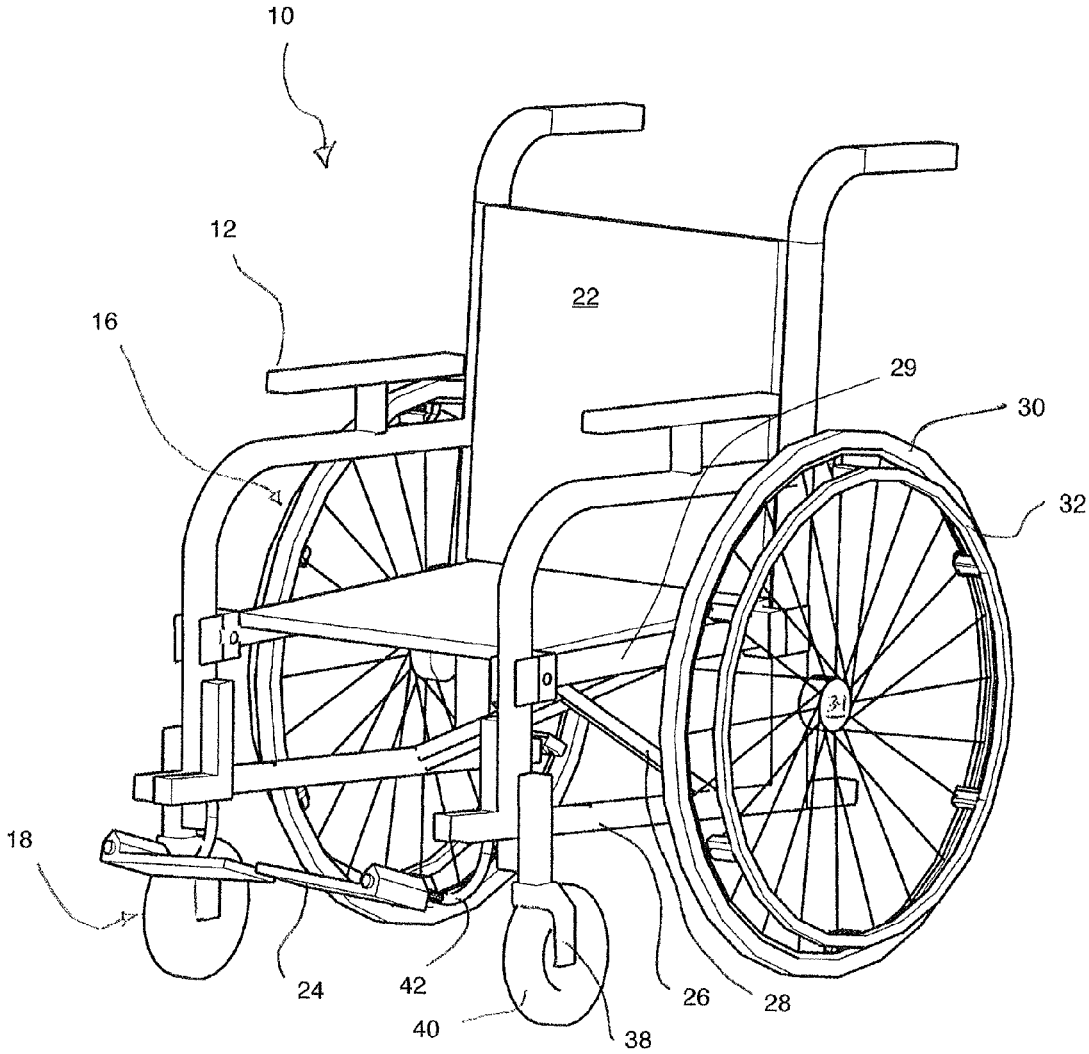
FIG. 1 is a simplified perspective view of a conventional wheelchair as known in the prior art.

Referring to FIG. 1, one embodiment of a conventional wheelchair 10 includes a frame 12, rear wheel assemblies 16 rotatably mounted to the frame 12, front caster assemblies 18 pivotally mounted to the frame 12, and a seat assembly 22 and footrests 24 that are fixedly mounted to the frame 12.

The frame 12 includes side frames 26 joined by pivotally connected crossbars 28. The crossbars 28 have upper and lower ends, the lower end of each crossbar 28 being pivotally connected to a lower horizontal structural member of a corresponding side frame 26 and the upper end of each crossbar 28 being pivotally connected to a longitudinal bar 29 that is slidingly attached to vertical structural members of the other side frame 26. The side frames 26, the pivotally connected crossbars 28, and the longitudinal bars 29 are arranged so as to permit collapsing motion of the side frames 26 toward each other and deploying motion of the side frames 26 away from each other. Each side frame 26 typically is fabricated by bending and fastening together structural members manufactured from extruded metal tubing. The side frames 26 also can be fabricated by stamping, injection molding, composite wrapping, or other known techniques for making strong, durable, and lightweight articles. The crossbars 28 and the longitudinal bars 29 can be made from stamped metal, or by other conventional methods.

Each rear wheel assembly 16 conventionally includes a drive wheel 30 and a push rim 32, which are radially connected to enable a wheelchair occupant to propel the chair using their arms and upper body. The drive wheel 30 is radially connected to a hub 34. For rotary motion of the rear wheel assembly 16, the hub 34 is rotatably mounted to the side frame 26. The drive wheel 30 typically includes a metal or hard polymer rim on which is mounted a soft polymer tire. The push rim 32 typically includes a metal or hard polymer rail extending circumferentially, and optionally includes a soft grip mounted on the rail.

Each of the front caster assemblies 18 includes a wheel bracket 38 that is pivotally connected to the side frame 26. Each of the front caster assemblies 18 also includes a front wheel 40 that is rotatably mounted within the wheel bracket 38. Accordingly, the front wheel 40 can freely swivel to permit steering the wheelchair 10 without wheel skid.

The seat assembly 22 includes conventional elements for supporting the wheelchair occupant such as a seat back supported between upper vertical structural members of the side frames 26, arm rests supported on upper horizontal structural members of the side frames 26, and a sling seat that is supported between the longitudinal bars 29. The seat assembly 22 also includes a push bar to allow the wheelchair to be pushed by an aide. The elements of the seat assembly 22 that extend between the side frames 26 typically are made of fabric or flexible polymer to permit collapsing and deploying motion of the side frames 26.

The footrests 24 are provided at the front of the frame 12 to support the feet and lower legs of the wheelchair occupant. Each footrest 24 typically is pivotally supported on a bar 42 mounted to one of the side frames 26. The footrests 24 typically may be pivoted up and out of the way around the bars 42 for ease of entering or leaving the wheelchair 10. However, once lowered for use by the wheelchair occupant, the footrests are fixedly mounted to the frame 12. As a result, the occupant's legs are stationary while seated in the wheelchair 10, leading to the problem of atrophy discussed above.

Figure 2:
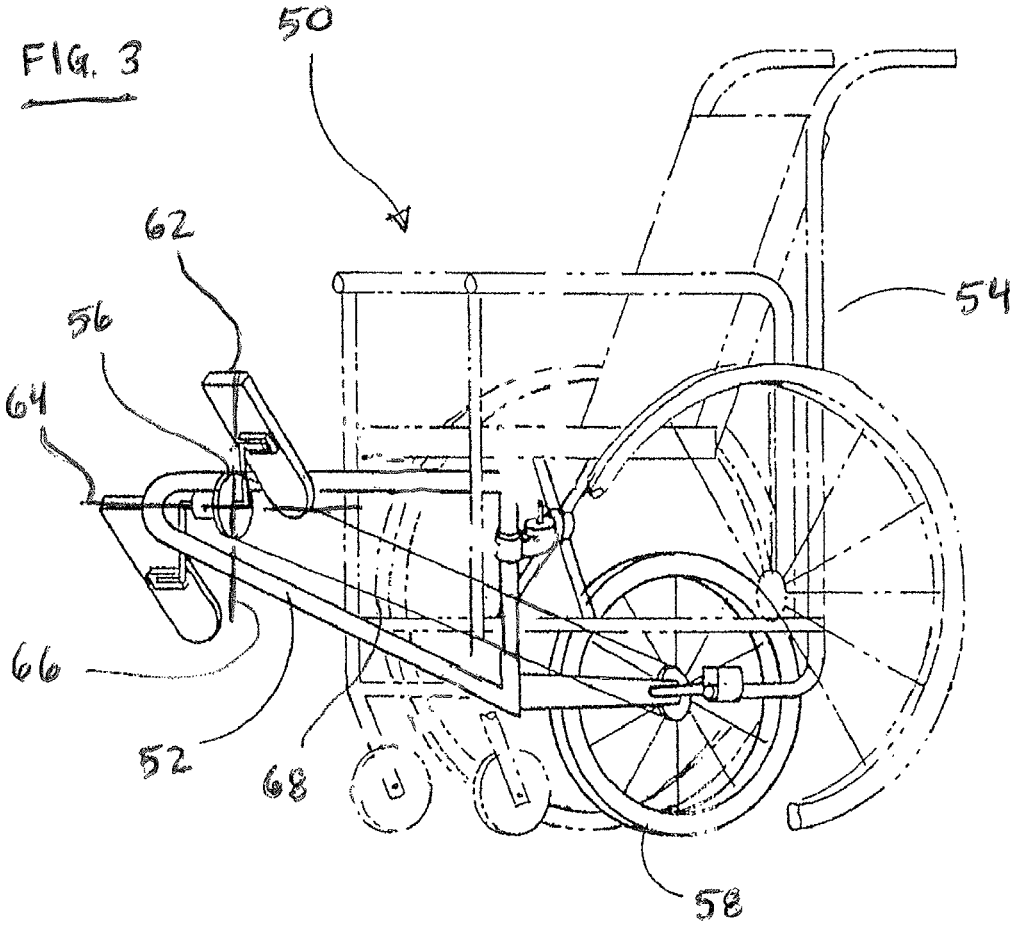
FIG. 2 is a simplified perspective view of a wheelchair cycle as known in the prior art.

Accordingly, wheelchair cycles have been proposed to provide exercise for a wheelchair occupant. Referring to FIG. 2, a wheelchair cycle apparatus 50, as disclosed by the '060 patent, is provided by connecting a cycle frame 52 to a conventional wheelchair frame 54. The cycle frame 52 protrudes forward from the wheelchair frame 54, and supports a forward wheel 56 and a rearward wheel 58. Pedals 62 are attached to the forward wheel 56, which defines an approximately horizontal axis of pedal rotation 64 and also defines a vertical axis 66 perpendicular to the horizontal axis 64. A chain 68 connects the forward wheel 56 to the rearward wheel 58. A brake (not shown) can be attached to the rearward wheel 58. When the pedals 62 are attached to the forward wheel 56, a wheelchair occupant having minimal leg function can exercise his/her legs by pedaling. Optionally, the brake can be attached to the rearward wheel 58 for increased exercise.

Figure 3:
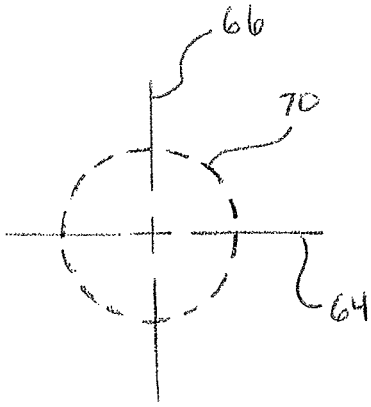
FIG. 3 is a schematic illustration showing a motion envelope for pedals of the wheelchair cycle of FIG. 2.

In operation, the pedals 62 revolve around the horizontal axis 64, defining an approximate motion envelope 70 as shown in FIG. 3. It has been discovered that cycling motion, such as that of the motion envelope 70 in FIG. 3, can adversely affect the ligaments and cartilage of a wheelchair occupant's knees, leading to further deterioration of the wheelchair occupant's legs.

Figure 4:
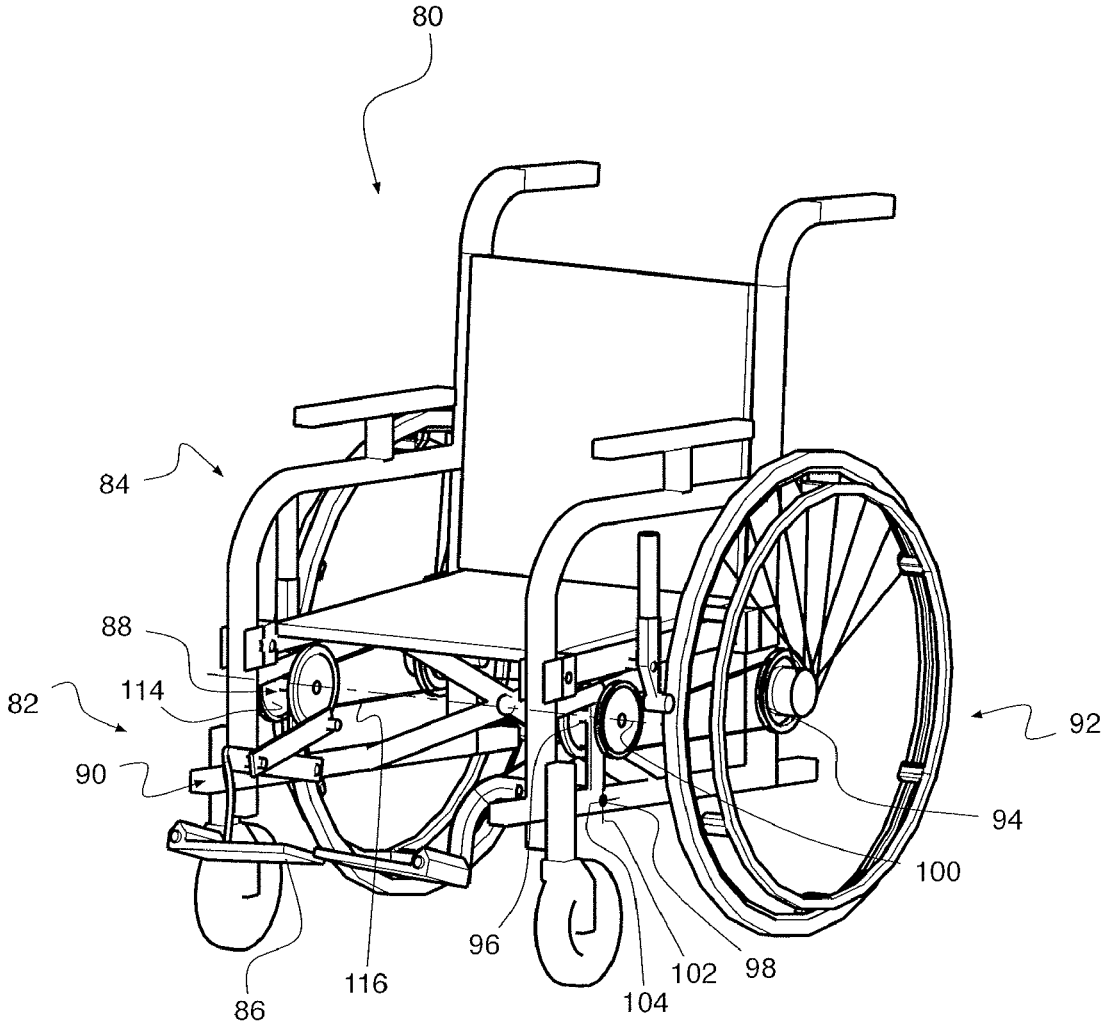
FIG. 4 is a simplified partial perspective view of an atrophy-reducing wheelchair according to an embodiment of the present invention.

Referring to FIG. 4, an atrophy-reducing wheelchair 80, according to an embodiment of the present invention, includes many elements similar to the conventional wheelchair 10 shown in FIG. 1. However, in place of the fixedly mounted footrests 24 shown in FIG. 1, the atrophy-reducing wheelchair 80 includes a movable foot support assembly 82 that is mounted to a modified side frame 84 for motion substantially parallel to the modified side frame 84.

In the embodiment shown in FIG. 4, the movable foot support assembly 82 comprises a foot support 86 movably connected to the modified side frame 84 and to an axle assembly 88 by a rocker linkage 90.

The modified side frame 84 includes a rear wheel mount (not shown) for receiving an axle of a modified rear wheel assembly 92. A drive wheel 94 is rigidly mounted to the modified rear wheel assembly 92. The modified side frame 84 further includes a journal 96 for mounting the axle assembly 88 and a pivot 98 for mounting the rocker linkage 90. The journal 96 defines a journal axis 100, while the pivot 98 defines a vertical axis 102 and a horizontal axis 104.

Figure 5:
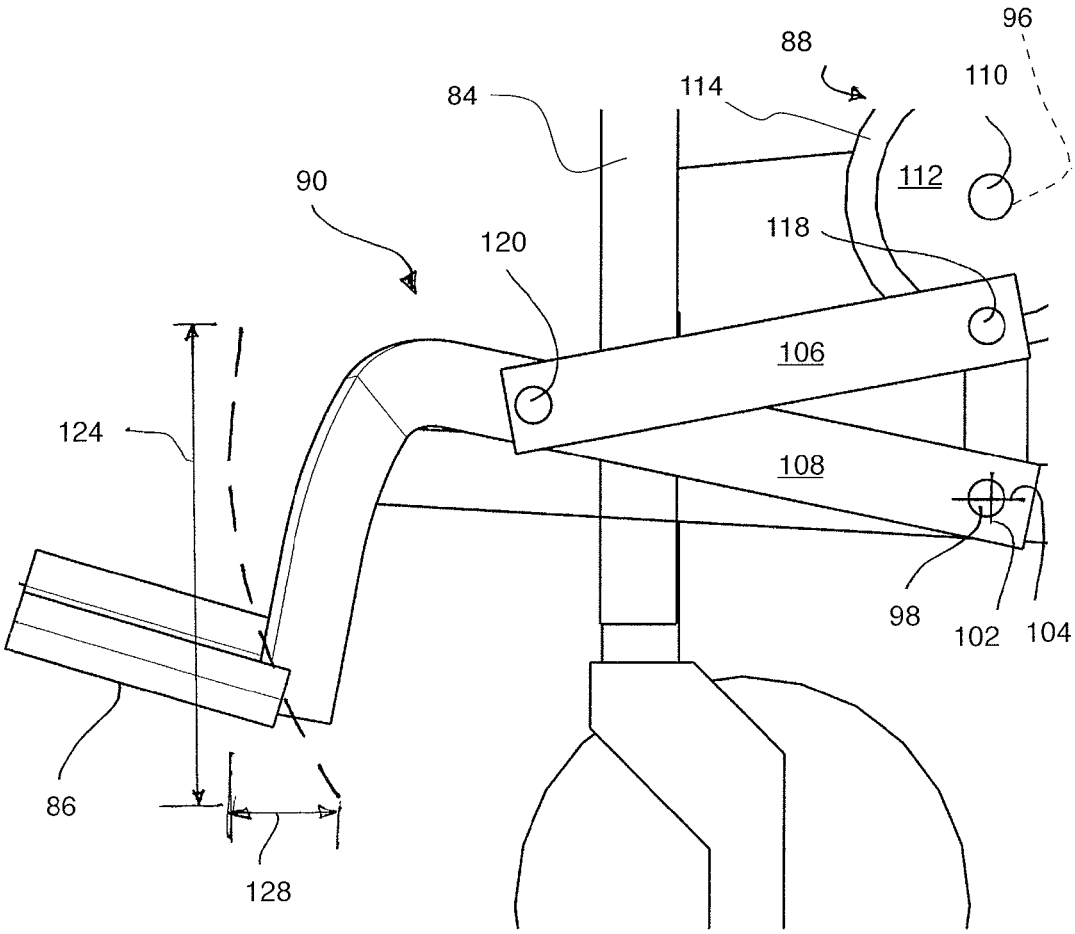
FIG. 5 is a simplified partial perspective view of a belt tensioner and wheel brake for the atrophy-reducing wheelchair of FIG. 4.

Referring to FIG. 5, the rocker linkage 90 includes a push-rod 106 having a driven end and a driving end, and a crank arm 108 having a proximal end and a distal end joined by a middle segment. As shown in FIG. 5, the foot support 86 is pivotally mounted on the distal end of the crank arm 108; however, the foot support 86 can be pivotally or fixedly connected to either the push-rod 106 or the crank arm 108. The axle assembly 88 includes an axle 110 that is rotatably mounted in the journal 96. The axle assembly 88 also includes a driven wheel 112 rigidly mounted to an inner end of the axle 110, and a belt wheel 114 rigidly mounted to an outer end of the axle 110. The driven end of the push-rod 106 is pivotally connected to the driven wheel 112 by a rod pin 118. The driving end of the push-rod 106 is pivotally connected to the middle segment of the crank arm 108 by a crank pin 120. The crank arm 108 is pivotally mounted to the modified side frame 84 at the pivot 98. The dimensions of the driven wheel 112, the push-rod 106, and the crank arm 108, and the locations of the rod pin 118, the crank pin 120, and the pivot 98 are chosen to provide a "rocker" configuration, whereby rotation of the driven wheel 112 is transformed into reciprocating motion of the distal end of the crank arm 108.

Referring back to FIG. 4, a belt 116 engages an outer circumferential surface of the belt wheel 114 to flexibly couple the belt wheel 114 to the drive wheel 94, thereby transferring rotation from the modified rear wheel assembly 92 to the linkage 90 through the drive wheel 94, the belt 116, and the axle assembly 88.

Figure 6:
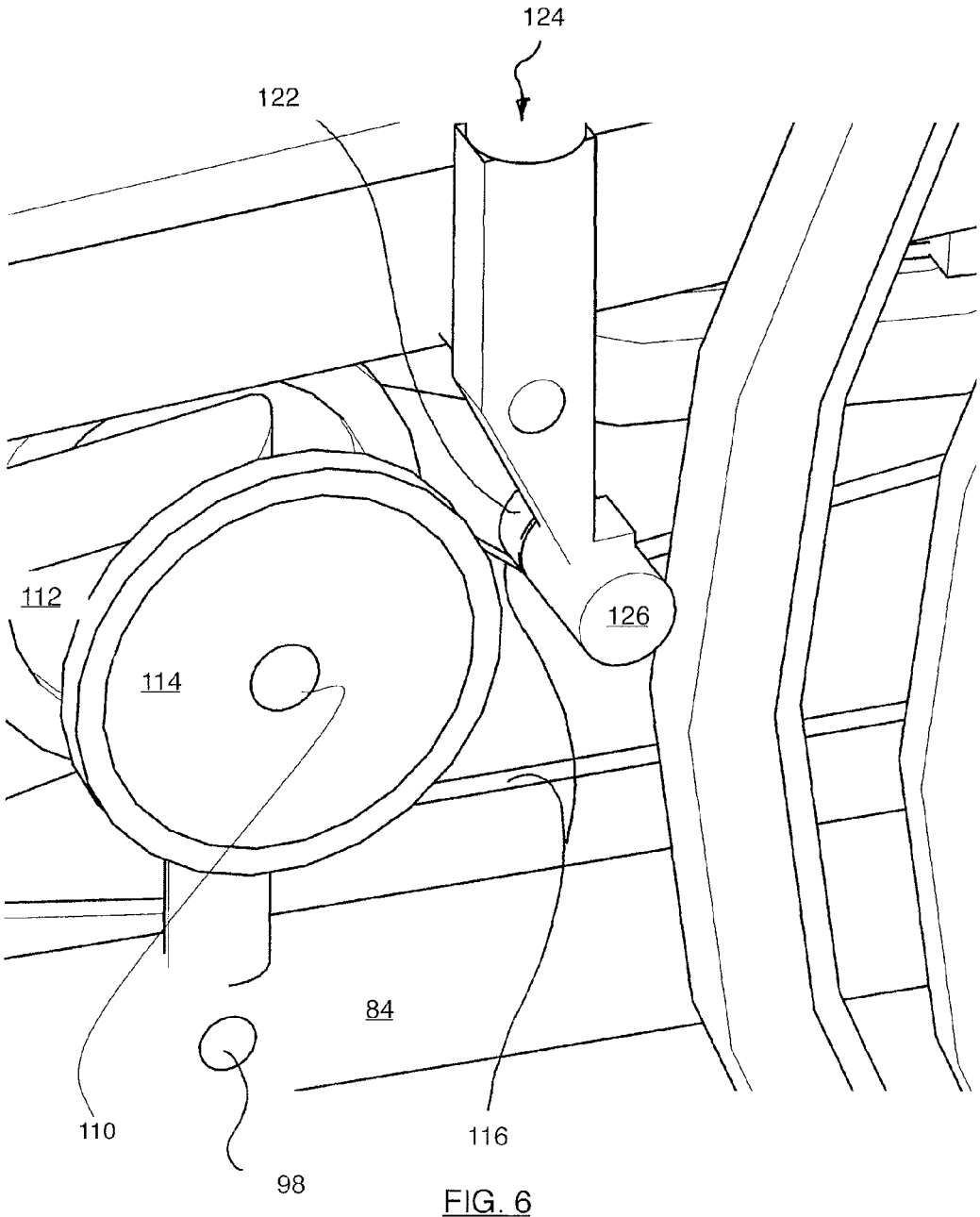
FIG. 6 is a side view showing a motion envelope of a movable foot support for the atrophy-reducing wheelchair of FIG. 4.

Referring to FIG. 6, since it may be desirable to disengage the linkage 90 when the atrophy-reducing wheelchair 80 is not in motion, a belt tensioner 122 is provided for engaging or releasing tension of the belt 116 around the drive wheel 94 and the belt wheel 114. The belt tensioner 122 can be made part of a wheel brake assembly 124, so that when the wheel brake 126 is engaged the belt tensioner 122 is released. In one embodiment of the present invention, the wheel brake assembly 124 is movable to an intermediate position whereby both the belt tensioner 122 and the wheel brake 126 are released.

Each part of the atrophy-reducing wheelchair 80 can be made from materials well-known in the art. For example, stamped metal, extruded and bent tubing, injection-molded polymers or fiber-resin composites all are suitable materials for the components of the rocker linkage 90. The belt 116 can be fabricated from vinyl, rubber, leather, cotton, polyethylene, or any combination of flexible and moderately elastic materials having an adequate coefficient of static friction on the materials chosen for the belt wheel 114 and the drive wheel 94.

Figure 7:
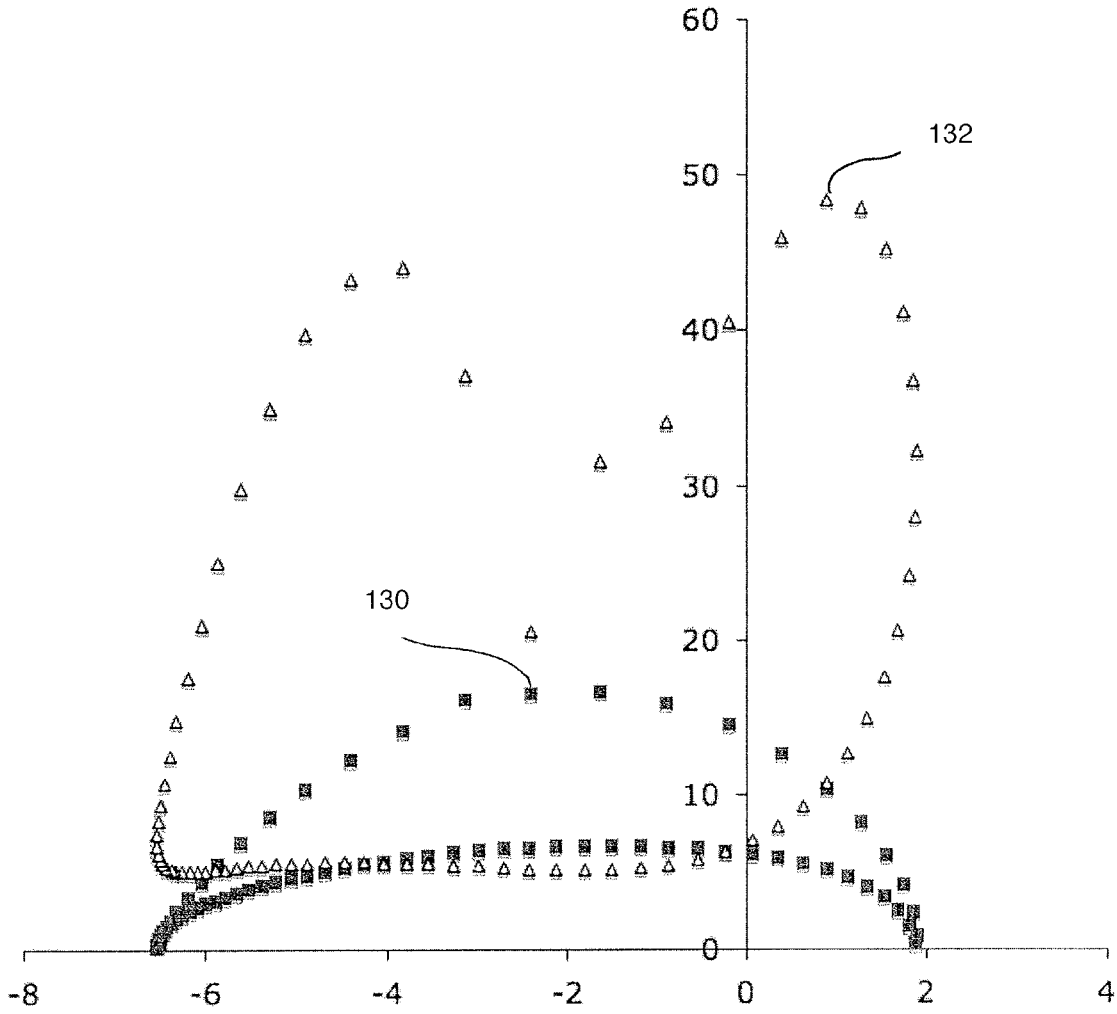
FIG. 7 is a schematic illustration showing exemplary velocities and forces for the movable foot support assembly of FIGS. 4 and 6.

Referring to FIGS. 5 and 7, the rocker linkage 90 provides substantially linear reciprocating motion of the foot support 86 in a plane substantially perpendicular to the journal axis 100. Specifically, dimensions of the driven wheel 112, the pushrod 106, and the crank arm 108, and locations of the rod pin 118, the crank pin 120, the journal 96, and the pivot 98, are chosen to provide gentle and substantially linear vertical reciprocation of the foot support 86 when the atrophy-reducing wheelchair 80 is moved forward or backward. In the example shown in FIGS. 5 and 7, the atrophy-reducing wheelchair 80 can be moved at approximately a normal walking pace of one meter per second (1 m/s). The foot support 86 reciprocates through a vertical travel 124 of approximately five (5) inches approximately once per second, with a maximum horizontal travel 128 of approximately two (2) inches, and presents a maximum velocity 130 of about eighteen inches per second (18 in/s) and a maximum upward force 132 of about one and one-tenths gravity (1.1 g) to the feet of an occupant seated in the atrophy-reducing wheelchair 80.

It is expected that, for typical wheelchair occupants, the gently vertically reciprocating motion of the foot support 86 will result in reduced rates of leg muscle atrophy and ligament contracture, and also will result in superior longevity of knee joint tissue compared to the wheelchair cycle apparatus 50 shown in FIG. 2.

Although this invention has been shown and described with respect to the detailed embodiments thereof, it will be understood by those of skill in the art that various changes may be made and equivalents may be substituted for elements thereof without departing from the scope of the invention.

Figure 8:
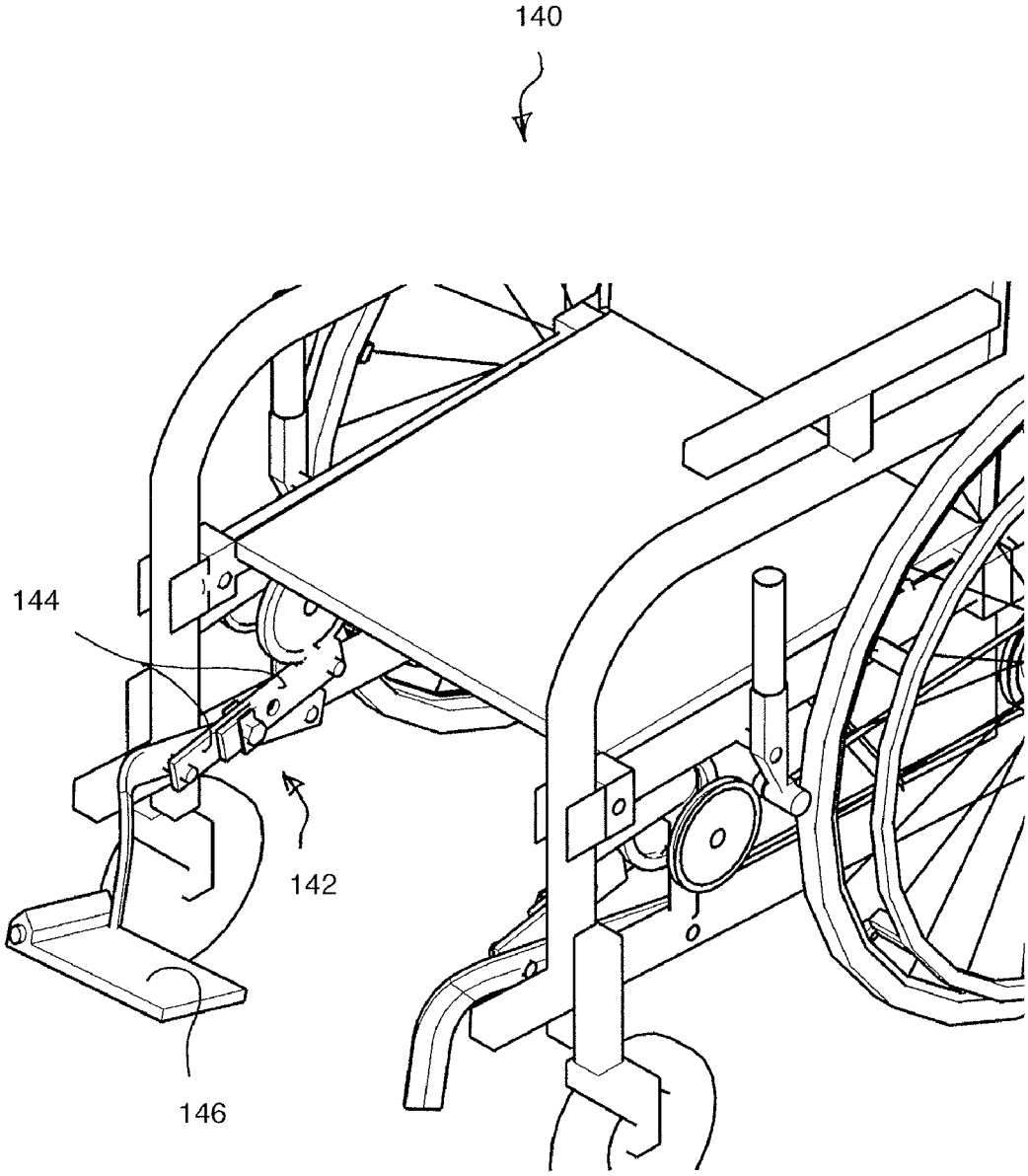
FIG. 8 is a simplified partial perspective view of an adjustable movable foot support assembly on an atrophy-reducing wheelchair according to another embodiment of the present invention.

For example, since it may be desirable to adjust the motion of the movable foot support to accommodate differing leg lengths of a plurality of potential wheelchair occupants, an atrophy-reducing wheelchair 140 shown in FIG. 8 can be provided with an adjustable four-bar linkage 142. The adjustable four-bar linkage 142 includes an adjustable push-rod 144. Increasing the length of the adjustable push-rod 144 will tend to shift a movable foot support 146 downward.

As another example, motion of the foot support 86 could be further varied by mounting the foot support 86 to the push-rod 106 in a Hoekens linkage configuration, rather than to the crank arm 108 as in the rocker linkage 90. In the Hoekens linkage configuration, selecting appropriate dimensions of the push-rod 106 and the crank arm 108 will result in linear motion of the foot support 86 in one direction and curvilinear motion of the foot support 86 in the other direction. However, the Hoekens linkage configuration can result in somewhat greater forces than are provided by the rocker linkage 90. To mitigate the effects of rapid acceleration on the wheelchair occupant, an absorbing member such as a gas spring can be included in the Hoekens linkage configuration.

As another example, a movable foot support also can be driven by a pantograph linkage that is actuated by a rotary cam directly mounted to a rear wheel of a wheelchair.

As another example, while a belt-driven linkage is believed to be simple and easily maintained, a chain-driven linkage could be used by substituting a chain for the belt 116 and substituting a derailleur for the belt tensioner 122.

As a further example, although the present invention has been described with reference to collapsible hand-propelled wheelchair embodiments, adaptation of a hand-propelled embodiment for use on a motor-driven wheelchair would be within the scope of one having ordinary skill in the art.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above-detailed description, but that the invention will include all embodiments falling within the scope of this disclosure.

What is claimed is:

1. An atrophy-reducing wheelchair comprising:

first and second side frames, each side frame including structural members lying substantially in a corresponding plane, a front wheel bracket pivotally connected to one of the structural members, and a rear wheel mount formed in one or another of the structural members and defining a rear wheel axis, the rear wheel axis of the second side frame being substantially in registration with the rear wheel axis of the first side frame, and the second side frame being offset from the first side frame along the rear wheel axes, and at least one of the first and second side frames being modified to include a pivot defining a pivot axis substantially perpendicular to the plane of the corresponding side frame and offset from the rear wheel axis, and also defining horizontal and vertical axes substantially perpendicular to the pivot axis and a journal defining a journal axis substantially perpendicular to the plane of the corresponding side frame and offset from the pivot axis and from the rear wheel axis;

a front wheel rotatably mounted to each front wheel bracket;

a rear wheel rotatably mounted to each rear wheel mount, the front and rear wheels cooperating to support the side frames;

first and second pivotally connected crossbars having upper and lower ends and together defining a plane substantially perpendicular to the first and second planes, the lower end of the first crossbar being pivotally connected to the second side frame and the upper end of the first crossbar carrying a first longitudinal bar lying substantially in the first plane and slidably connected to the first side frame, the lower end of the second crossbar being pivotally connected to the first side frame and an upper end of the second crossbar carrying a second longitudinal bar lying substantially in the second plane and slidably connected to the second side frame, the crossbars and longitudinal bars cooperating to permit motion of the first and second side frames between an open position in which the second side frame is offset from the first side frame by a seat width and a closed position in which the second side frame is offset from the first side frame by a collapsed width;

a seat supported between the first and second longitudinal bars; and at least one linkage movably connected to the modified side frame at the pivot and the journal, the linkage operatively connecting a movable foot support to the rear wheel of the modified side frame, wherein rotation of the rear wheel drives the linkage to move the movable foot support in a substantially linear vertical oscillating motion.

2. The atrophy-reducing wheelchair according to claim 1, wherein the linkage includes a drive wheel fixedly and substantially co-axially mounted to the rear wheel of the modified side frame, a crank arm having proximal and distal ends joined by a middle segment, the proximal end of the crank arm being pivotally connected to the pivot of the modified side frame and the foot support being carried at the distal end of the crank arm, a push-rod having driven and driving ends, the driving end of the push-rod being pivotally joined to the middle segment of the crank arm, and an axle assembly rotatably mounted in the journal of the modified side frame and including a rod pin and an outer circumferential surface, the driven end of the push-rod being pivotally connected to the rod pin, the outer circumferential surface of the axle assembly engaging a flexible member, and the flexible member extending from the outer circumferential surface of the axle assembly to an outer circumferential surface of the drive wheel.

3. The atrophy-reducing wheelchair according to claim 2, wherein dimensions of the axle assembly, the push-rod, and the crank arm are selected so as to provide substantially linear reciprocating motion to the foot support as the drive wheel rotates.

4. The atrophy-reducing wheelchair according to claim 2, further comprising a tensioner associated with the flexible member and integrated with a wheel brake assembly mounted to the wheelchair frame.

5. The atrophy-reducing wheelchair according to claim 2, wherein the modified side frame includes a plurality of journals so that the motion of the foot support can be selected by rotatably mounting the axle assembly in one of the plurality of journals.

6. The atrophy-reducing wheelchair according to claim 2, wherein the modified side frame includes a plurality of pivots so that the motion of the foot support can be selected by pivotally connecting the proximal end of the crank arm to one of the plurality of pivots.

7. The atrophy-reducing wheelchair according to claim 2, wherein at least one of the push-rod and the crank arm can be adjusted in length to vary the motion of the foot support.

8. The atrophy-reducing wheelchair according to claim 1, wherein the linkage includes a push-rod having driven and driving ends joined by a middle segment, with the foot support being carried at the driving end of the push-rod, a crank arm having proximal and distal ends, with the distal end of the crank arm pivotally joined to the middle segment of the push-rod and the proximal end of the crank arm pivotally connected to the pivot of the modified side frame, an axle assembly rotatably mounted in the journal of the modified side frame and having a rod pin and an outer circumferential surface, with the driven end of the push-rod being pivotally connected to the rod pin, a drive wheel fixedly and substantially co-axially mounted to the rear wheel, and a flexible member extending from the outer circumferential surface of the axle assembly to an outer circumferential surface of the drive wheel, such that rotation of the rear wheel of the modified side frame causes oscillating motion of the movable foot support.

9. The atrophy-reducing wheelchair according to claim 8, wherein dimensions of the axle assembly, the push-rod, and the crank arm are selected so as to provide substantially linear reciprocating motion to the foot support as the drive wheel rotates.

10. The atrophy-reducing wheelchair according to claim 8, further comprising a tensioner for engaging or disengaging the flexible member around the outer circumferential surfaces of the drive wheel and the axle assembly.

11. The atrophy-reducing wheelchair according to claim 10, wherein the tensioner is integrated with a wheel brake assembly mounted to the wheelchair frame.

12. The atrophy-reducing wheelchair according to claim 8, wherein the first side frame includes a plurality of journals so that the motion of the foot support can be selected by rotatably mounting the axle assembly in one of the plurality of journals.

13. The atrophy-reducing wheelchair according to claim 8, wherein the first side frame includes a plurality of pivots so that the motion of the foot support can be selected by pivotally connecting the proximal end of the crank arm to one of the plurality of pivots.

14. The atrophy-reducing wheelchair according to claim 8, wherein at least one of the push-rod and the crank arm can be adjusted in length to vary the motion of the foot support.

15. The atrophy-reducing wheelchair according to claim 1, wherein the linkage is arranged with respect to the side frames such that the linkage does not limit the motion of the side frames toward each other.

16. The atrophy-reducing wheelchair according to claim 1, wherein the outer dimensions of the atrophy-reducing wheelchair match the outer dimensions of a conventional wheelchair.

17. An atrophy-reducing foot support assembly for use on a wheelchair having first and second side frames, each side frame including rigidly connected structural members lying substantially in a corresponding plane, a front wheel bracket pivotally connected to a first of the structural members, and a rear wheel mount formed in the first or in a second of the structural members and defining a rear wheel axis, the rear wheel axis of the second side frame being substantially in registration with the rear wheel axis of the first side frame, and the second side frame being offset from the first side frame along the rear wheel axes, and at least one of the first and second side frames being modified to include a pivot and a journal, each journal defining a journal axis substantially perpendicular to the plane of the corresponding side frame, each pivot defining a pivot axis substantially perpendicular to the plane of the corresponding side frame and also defining horizontal and vertical axes substantially perpendicular to the pivot axis, the wheelchair further including a seat supported by the first and second side frames, a front wheel rotatably mounted to each front wheel bracket, and a rear wheel rotatably mounted to each rear wheel mount, the assembly comprising:

a foot support;

a crank arm having a proximal end, a distal end, and a middle segment connecting the proximal and distal ends, the distal end carrying the foot support and the proximal end being pivotally mounted to the pivot of the modified side frame;

an axle assembly rotatably mounted in the journal of the modified side frame, having an outer circumferential surface and having a rod pin extending substantially parallel to the journal axis at a radial distance from the journal axis;

a push-rod having a driven end and having a driving end, the driven end being pivotally connected to the rod pin;

a crank pin pivotally connecting the driving end of the push-rod to the middle segment of the crank arm;

a drive wheel fixedly and substantially co-axially mounted to the rear wheel of the modified side frame, the drive wheel having an outer circumferential surface; and a member engaging the outer circumferential surface of the axle assembly and the outer circumferential surface of the drive wheel, thereby flexibly coupling the axle assembly to the drive wheel, wherein rotation of the rear wheel of the modified side frame causes substantially vertical substantially linear oscillating motion of the foot support.

18. An atrophy-reducing foot support assembly for use on a wheelchair having first and second side frames, each side frame including rigidly connected structural members lying substantially in a corresponding plane, a front wheel bracket pivotally connected to a first of the structural members, and a rear wheel mount formed in the first or in a second of the structural members and defining a rear wheel axis, the rear wheel axis of the second side frame being substantially in registration with the rear wheel axis of the first side frame, and the second side frame being offset from the first side frame along the rear wheel axes, and at least one of the first and second side frames being modified to include a pivot and a journal, each journal defining a journal axis substantially perpendicular to the plane of the corresponding side frame, each pivot defining a pivot axis substantially perpendicular to the plane of the corresponding side frame and also defining horizontal and vertical axes substantially perpendicular to the pivot axis, the wheelchair further including a seat supported by the first and second side frames, a front wheel rotatably mounted to each front wheel bracket, and a rear wheel rotatably mounted to each rear wheel mount, and the assembly comprising:

a foot support;

an axle assembly rotatably mounted in the journal of the modified side frame, having an outer circumferential surface and having a rod pin extending substantially parallel to the journal axis at a radial distance from the journal axis;

a push-rod having a driven end, a driving end, and a middle segment connecting the driving and driven ends, the driving end carrying the foot support and the driven end being pivotally connected to the rod pin;

a crank arm having a proximal end and a distal end, the distal end being pivotally mounted to the middle segment of the push-rod by a crank pin, and the proximal end being pivotally mounted to the pivot of the modified side frame;

a drive wheel fixedly and substantially co-axially mounted to the rear wheel of the modified side frame, the drive wheel having an outer circumferential surface; and a flexible member engaging the outer circumferential surface of the axle assembly and the outer circumferential surface of the drive wheel, thereby flexibly coupling the axle assembly to the drive wheel, wherein rotation of the rear wheel of the modified side frame causes substantially linear vertical motion of the foot support, and at least one of the push-rod and the crank arm can be adjusted in length to vary the motion of the foot support.

* * * * *